US009676187B2

(12) United States Patent
Ge et al.

(10) Patent No.: US 9,676,187 B2
(45) Date of Patent: Jun. 13, 2017

(54) FLUID EJECTION DEVICE

(71) Applicant: HEWLETT-PACKARD DEVELOPMENT COMPANY, L.P., Houston, TX (US)

(72) Inventors: Ning Ge, Palo Alto, CA (US); Mun Hooi Yaow, Singapore (SG); Bee Ling Peh, Singapore (SG)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/787,233

(22) PCT Filed: Jul. 29, 2013

(86) PCT No.: PCT/US2013/052460
§ 371 (c)(1),
(2) Date: Oct. 26, 2015

(87) PCT Pub. No.: WO2015/016806
PCT Pub. Date: Feb. 5, 2015

(65) Prior Publication Data

US 2016/0114580 A1 Apr. 28, 2016

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.
CPC ..... *B41J 2/14016* (2013.01); *B41J 2/1412* (2013.01); *B41J 2/14072* (2013.01);
(Continued)

(58) Field of Classification Search
CPC .. B41J 2/1412; B41J 2/14112; B41J 2/14088; B41J 2/14137; B41J 2202/16
See application file for complete search history.

(56) References Cited

U.S. PATENT DOCUMENTS 5,081,473 A 1/1992 Hawkins et al.
5,169,806 A * 12/1992 Hawkins ..... B41J 2/14072 148/DIG. 122

(Continued)

FOREIGN PATENT DOCUMENTS

| | | |
|---|---|---|
| CN | 101098788 A | 1/2008 |
| CN | 103003073 A | 3/2013 |
| JP | 2005041176 | 2/2005 |

OTHER PUBLICATIONS

Lee, et al.; A New Monolithic Thermal Inkjet Printhead Using Single Crystalline Silicon Island as a Heating Resistor Isolated by Oxidized Porous Silicon; Journal of the Korean Physical Society; vol. 33; Nov. 1998, pp. S458-S461.

*Primary Examiner* — Juanita D Jackson
(74) *Attorney, Agent, or Firm* — HP Inc. Patent Department

(57) ABSTRACT

A fluid ejection device is described. In an example, a device includes a substrate having a chamber formed thereon to contain a fluid. A metal layer includes a resistor under the chamber having a surface thermally coupled to the chamber. At least one layer is deposited on the metal layer. A polysilicon layer is under the metal layer comprising a polysilicon structure under the resistor to change topography of the resistor such that the surface is uneven.

12 Claims, 4 Drawing Sheets

(52) U.S. Cl.
CPC ..... *B41J 2/14129* (2013.01); *B41J 2/1601* (2013.01); *B41J 2/164* (2013.01); *B41J 2/1626* (2013.01)

(56) References Cited

U.S. PATENT DOCUMENTS

| | | | | |
|---|---|---|---|---|
| 5,943,076 | A | 8/1999 | Burke et al. | |
| 6,299,294 | B1 | 10/2001 | Regan | |
| 6,315,384 | B1 | 11/2001 | Ramaswami et al. | |
| 6,457,815 | B1 * | 10/2002 | Miller ..... | B41J 2/1408 347/63 |
| 2002/0094301 | A1 | 7/2002 | Tydings | |
| 2002/0097301 | A1 | 7/2002 | Chen et al. | |
| 2003/0001928 | A1 | 1/2003 | Miller et al. | |
| 2008/0094453 | A1 | 4/2008 | Rohlfing | |
| 2013/0063527 | A1 | 3/2013 | Ge et al. | |
| 2013/0083131 | A1 | 4/2013 | Chung et al. | |

* cited by examiner

FLUID EJECTION DEVICE

BACKGROUND

Inkjet technology is widely used for precisely and rapidly dispensing small quantities of fluid. Inkjets eject droplets of fluid out of a nozzle by creating a short pulse of high pressure within a firing chamber. During printing, this ejection process can repeat thousands of times per second. One way to create pressure in the firing chamber is by heating the ink in the firing chamber. A thermal inkjet (TIJ) device include a heating element (e.g., resistor) in the firing chamber. To eject a droplet, an electrical current is passed through the heating element. As the heating element generates heat, a small portion of the fluid within the firing chamber is vaporized. The vapor rapidly expands, forcing a small droplet out of the firing chamber and nozzle. The electrical current is then turned off and the heating element cools. The vapor bubble rapidly collapses, drawing more fluid into the firing chamber.

BRIEF DESCRIPTION OF THE DRAWINGS

Some embodiments of the invention are described with respect to the following figures.

DETAILED DESCRIPTION

Figure 1:
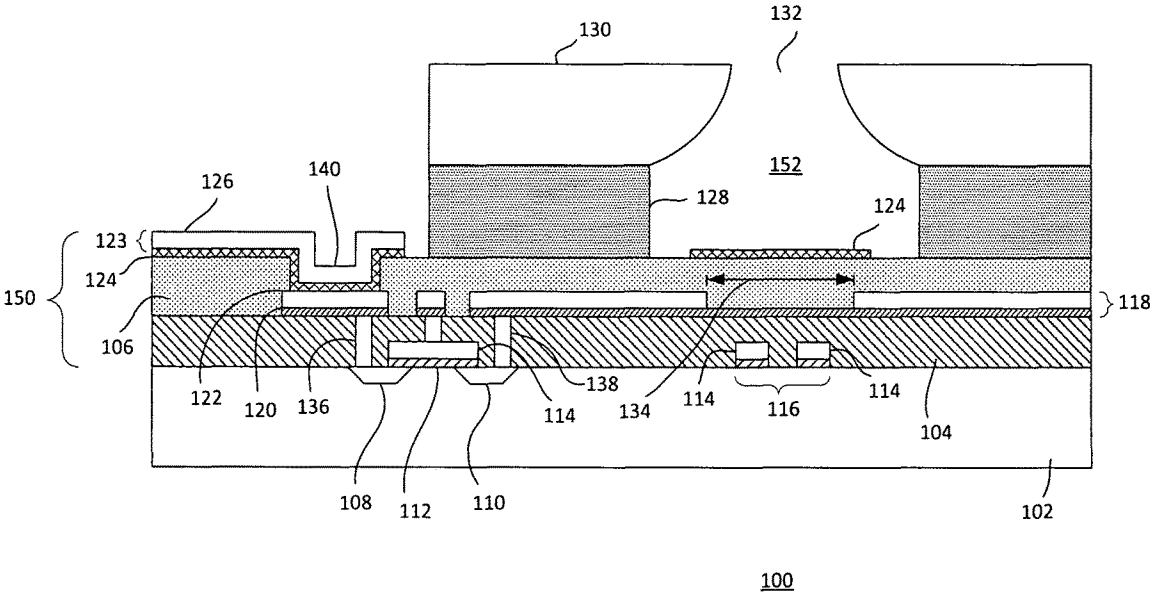
FIG. 1 is a cross-section diagram of a part of a fluid ejection device according to an example implementation.

FIG. 1 is a cross-section diagram of a part of a fluid ejection device 100 according to an example implementation. The fluid ejection device 100 may be used in a thermal inkjet (TIJ) printhead, for example. The fluid ejection device 100 includes a substrate 102, a thin-film stack 150, and a chamber 152 formed on the thin-film stack 150. The chamber 152 is formed within a barrier layer 128 and a plate layer 130, each deposited on the thin-film stack 150. The chamber 152 is fluidically coupled to a nozzle 132. The chamber 152 is configured to hold fluid (e.g., ink), which can be ejected from the nozzle 132.

The substrate 102 is a semiconductor substrate having doped regions, such as a doped region 108 and a doped region 110. The doped regions 108 and 110 can form a source and drain of a transistor. The thin-film stack 150 includes multiple layers deposited on the substrate 102 in a pattern. The layers in the thin-film stack 150 can be deposited and patterned using known semiconductor deposition and processing techniques. It is to be understood that FIG. 1 shows the thin-film stack schematically and omits topology details, such as the varying heights and thicknesses of the layers as they are deposited over the substrate 102. Where such details are necessary for understand example implementations, they will be shown in more detail in subsequent drawings described below.

In an example, the thin-film stack 150 includes a gate-oxide (GOX) layer 112, a polysilicon layer 114, a dielectric layer 104, a metal layer 118, a dielectric layer 106, and a metal layer 123. The GOX layer 112 is a first layer patterned on the substrate 102. The polysilicon layer 114 is patterned on the GOX layer 112. A portion of the polysilicon layer 114 can provide a gate for the transistor formed using the doped regions 108 and 110. Another portion of the polysilicon layer 114 provides a polysilicon structure 116, discussed in further detail below.

The dielectric layer 104 is deposited over the polysilicon layer 114. The dielectric layer 104 can be any type of insulating layer, such as silicon oxide, phosphosilicate glass (PSG), undoped silicate glass (USG), Silicon Carbide (SiC), Silicon Nitride (SiN), tetraethyl orthosilicate (TEOS), or the like, or combinations thereof. Vias (e.g., 136 and 138) can be formed in the dielectric layer 104 to expose portions of the polysilicon layer 114 and the substrate 102.

The metal layer 118 is deposited over the dielectric layer 104 and in the vias formed in the dielectric layer 104. The metal layer 118 can be formed from Tantalum (Ta), Aluminum (Al), Copper (Cu), Gold (AU), or the like or combinations thereof (e.g., TA and AU), including alloys or combinations thereof (e.g., TaAl, AlCu). The metal layer 118 can include multiple conductive layers. For example, conductive layers 120 and 122 are shown. The conductive layers 120 and 122 can have different sheet resistances (sheet resistance is resistance per unit). For example, the conductive layer 120 may have a higher sheet resistance than the conductive layer 122 such that, where the conductive layer 122 is present, the majority of the current goes through the conductive layer 122. Thus, the conductive layer 122 acts as a conducting line and may be used to route signals, and the conductive layer 120 acts as a resistive line, and may be used as a resistor. The metal layer 118 may be formed by first depositing the conductive layer 120, depositing the conductive layer 122, and then etching the conductive layer 122 to expose portions of the conductive layer 120. In particular, a portion 134 of the conductive layer 120 under the chamber 152 is exposed. The exposed portion 134 provides a surface of a resistor under the chamber 152 thermally coupled to the chamber 152.

The dielectric layer 106 is deposited over the metal layer 118. The dielectric layer 106 can be any type of insulating layer, such as silicon oxide, PSG, USG, SiC, SiN, TEOS, or the like or combinations thereof. Portions of the dielectric layer 106 can be etched to expose portions of the metal layer 118 (e.g., vias can be formed in the dielectric layer 106).

The metal layer 123 is deposited over the dielectric layer 106 and in the vias formed in the dielectric layer 106. The metal layer 123 can be formed from Tantalum (Ta), Aluminum (Al), Copper (Cu), Gold (AU), or the like or combinations thereof (e.g., TA and AU), including alloys or combinations thereof (e.g., TaAl, AlCu). The metal layer 123 can include multiple conductive layers, similar to the metal layer 118. For example, the metal layer 123 can include a conductive layer 124 and a conductive layer 126. The conductive layer 126 can be used to provide a bond pad 140 for receiving electrical signals from an external source (not shown). In some examples, the conductive layer 124 can provide an anti-cavitation layer to mitigate mechanical damage to lower layers under the chamber 152 due to collapse of a fluid bubble therein. In other examples, the conductive layer 124 can be omitted from beneath the chamber 152.

A resistor may be heated (fired) by sending a current pulse through it. Any appropriate method can be used to direct a current pulse to the desired resistor, for example, direct addressing, matrix addressing, or a smart drive chip in the fluid ejection device 100. Selection of which resistor to fire may be carried out by a processor in the fluid ejection device 100, a processor in a related controlling device, such as a printer, or a combination thereof. Once it has been determined to heat a particular resistor, a pulse of electric current can be delivered to the resistor through circuitry in the fluid ejection device 100.

FIG. 1 shows an example in which a current pulse may be delivered to a resistor formed from the exposed portion 134 of the conductive layer 120 under the chamber 152. The current can be coupled to the bond pad 140, through the metal layer 118, through a transistor formed from the doped regions 108 and 110, and to a portion of the metal layer 118 under the chamber 152 implementing the resistor. Of course, this signal route is merely an example, and variations and other configurations are possible.

It is to be understood that the layers of the thin-film stack 150 are not shown to scale. The layers can have various thicknesses depending on particular device configuration and processes used. In an example, the GOX layer 112 can have a thickness on the order of 750 Angstroms (A); the polysilicon layer 114 on the order of 3600 A; the dielectric layer 104 on the order of 13000 A; the metal layer 118 on the order of 5000 A; the dielectric layer 106 on the order of 3850 A; and the metal layer 123 on the order of 4600 A. Of course, these thicknesses are merely an example and variations and other configurations are possible. Moreover, the particular configuration of layers in the thin-film stack 150 is also provided by way of example. It is to be understood that additional dielectric and/or metal layers can be provided in different configurations. In general, the thin-film stack 150 as described herein provides a resistor beneath the chamber 152, and a polysilicon structure beneath the resistor. The polysilicon structure and its advantages are described immediately below.

The polysilicon structure 116 can include at least one polysilicon segment (e.g., two are shown in the cross-section). The polysilicon layer 114 can have a thickness such that it causes significant topography differences in the metal layer 118 within the exposed portion 134 (e.g., the surface of the resistor). This causes an uneven surface of the resistor, which improves the thermal efficiency of the resistor. In addition, the topology variation in the resistor surface can achieve lower static turn-on energy (STOE) for the resistor. Without the polysilicon structure 116, thermal efficiency can only be improved by using either thinner passivation layer (e.g., the dielectric layer 106) or thick thermal barrier underneath the resistor (e.g., the dielectric layer 104). A thinner passivation layer, however, is susceptible to pin holes resulting in loss of yield. A thicker thermal barrier layer increases cost. The polysilicon structure 116 will neither increase cost nor increase real-estate requirements for the die design.

In one example, the polysilicon structure 116 is passive and does not conduct current. In such examples, the polysilicon structure 116 is present only to alter the topology of the resistor surface to improve thermal efficiency. In another example, the polysilicon structure 116 or a portion thereof can be used to conduct current for various purposes. For example, the polysilicon structure 116 or a portion thereof may provide gate(s) for transistor(s) formed in the fluid ejection device 100 (e.g., the polysilicon structure can be part of the gate 114). In another example, the polysilicon structure 116 can be used as a secondary heating element in addition to the resistor since polysilicon has reasonable sheet resistance (e.g., 30 ohm per square). The secondary heater can warm the dielectric layer 104 to relieve heat loss to the silicon substrate 102.

Figure 2:
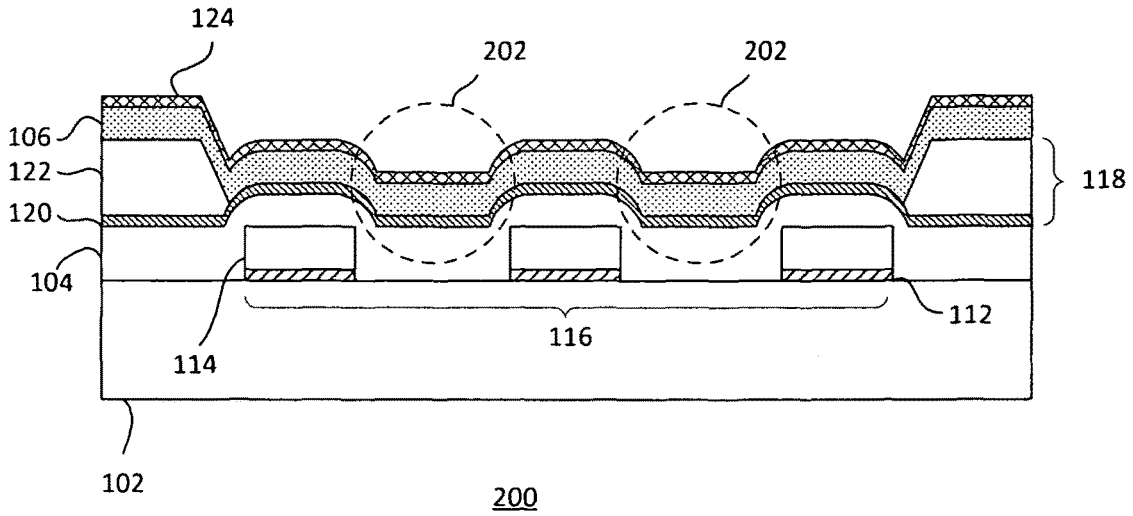
FIG. 2 is a cross-section diagram of a resistor portion of a fluid ejection device according to an example implementation.

FIG. 2 is a cross-section diagram of a resistor portion 200 of a fluid ejection device according to an example implementation. Elements of FIG. 2 that are the same or similar to those of FIG. 1 are designated with identical reference numerals and are described in detail above. The resistor portion 200 shows more detail of the fluid ejection device 100 under the chamber 152. The chamber 152 has been omitted for clarity. The resistor portion 200 includes the substrate 102, the GOX layer 112, the polysilicon layer 114, the dielectric layer 104, the metal layer 118, the dielectric layer 106, and the conductive layer 124 of the metal layer 123. The polysilicon structure 116 is positioned beneath the metal layer 118 forming the resistor. In particular, the polysilicon structure 116 is beneath the exposed portion of the conductive layer 120 that provides the resistor. Due to the thickness of the polysilicon layer 114, the surface of the conductive layer 120 is uneven (e.g., the surface exhibits "hills" and "valleys"). The "valleys" in the surface of the conductive layer 120 are emphasized by dashed circles 202. The valleys in the conductive layer 120 assist nucleation of fluid bubbles when a current pulse passes through the conductive layer 120 as compared to a flat surface. Thermal efficiency of the resistor is improved. The polysilicon structure 116 can include at least one polysilicon segment (e.g., 3 are shown in FIG. 2). Various configurations of the polysilicon structure 116 are described below.

Figure 3:
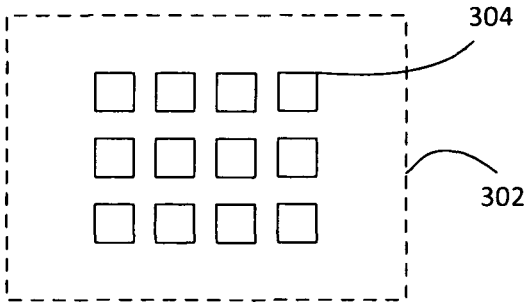
FIGS. 3-5 depict top-down views of the resistor portion of a fluid ejection device according to example implementations.
Figure 4:
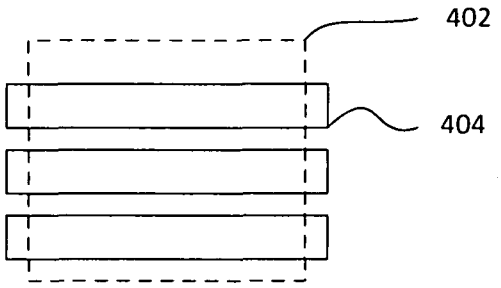
Figure 5:
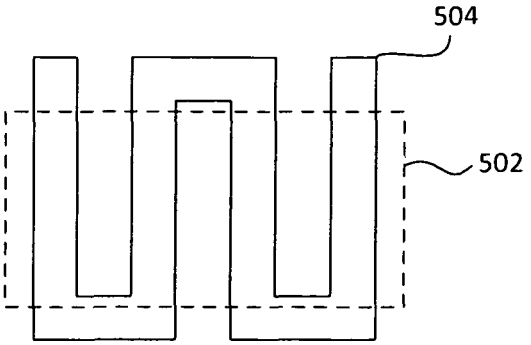

FIGS. 3-5 depict top-down views of the resistor portion of a fluid ejection device according to example implementations. As shown in FIG. 3, the resistor surface 302 is shown in dashed outline. The polysilicon structure includes a plurality of polysilicon segments 304 arranged in a grid formation. As shown in FIG. 4, a resistor surface 402 is shown in dashed outline. The polysilicon structure includes a plurality of segments 404 extending from one side of the resistor surface 402 to another side of the resistor surface 402. As shown in FIG. 5, a resistor surface 502 is shown in dashed outline. The polysilicon structure includes a plurality of segments 504 arranged in a serpentine formation. It is to be understood that the polysilicon structures shown in FIGS. 3-5 are mere examples and that structures of different variations and configurations can be provided to alter the surface of the resistor such that the resistor surface becomes uneven providing hills and valleys. In some examples, the polysilicon structures shown in FIGS. 3-5 are passive and do not conduct current. In other examples, all or a portion of the polysilicon structure shown in FIGS. 4 and 5 can be used for both altering resistor surface topology and another purposes, such as transistor gates or secondary heaters for warming the fluid.

Figure 6:
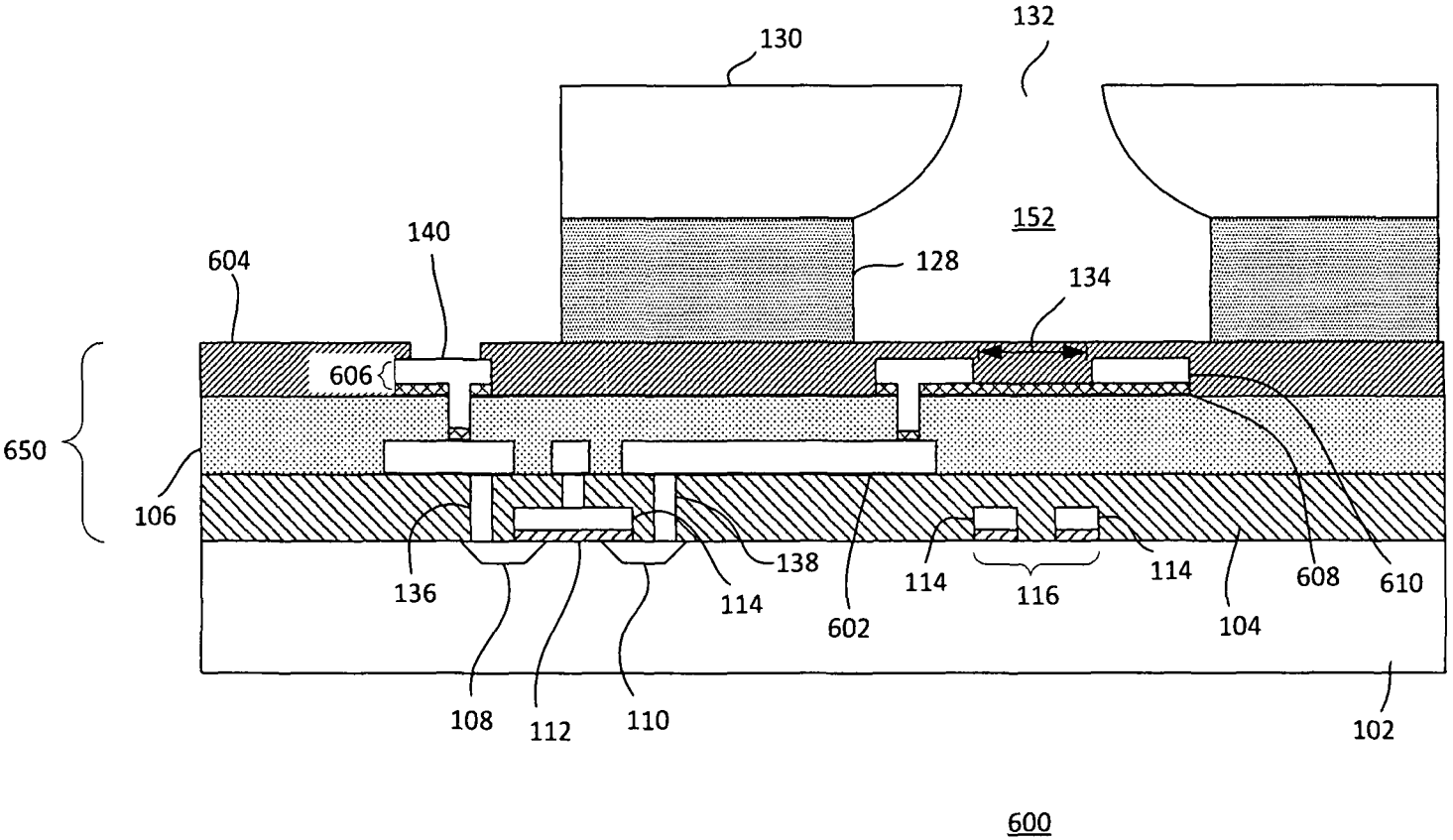
FIG. 6 is a cross-section diagram of a part of a fluid ejection device according to another example implementation.

FIG. 6 is a cross-section diagram of a part of a fluid ejection device 600 according to an example implementation. Elements of FIG. 6 that are the same or similar to those of FIG. 1 are designated with identical reference numerals and described in detail above. The device 600 is similar to the device 100, with the exception that the resistor is formed in the second metal layer, and the first metal layer can be used for signal routing. The device 600 is another example of using a polysilicon structure under a TIJ resistor to alter the topography of the resistor surface to improve thermal efficiency and STOE. It is to be understood that use of a polysilicon structure under a TIJ resistor can be employed in still further variations/configurations of fluid ejection devices, of which devices 100 and 600 are examples.

A thin-film stack 650 on the substrate 102 includes a first metal layer 602 deposited on the dielectric layer 104, and a second metal layer 606 deposited on the dielectric 106. The metal layers 602 and 606 can be formed from Tantalum (Ta), Aluminum (Al), Copper (Cu), Gold (AU), or the like or combinations thereof (e.g., TA and AU), including alloys or combinations thereof (e.g., TaAl, AlCu). A dielectric layer 604 is deposited over the metal layer 606. The dielectric layer 604 can be any type of insulating layer, such as silicon oxide, PSG, USG, SiC, SiN, TEOS, or the like, or combinations thereof.

The metal layer 606 can include multiple conductive layers. For example, conductive layers 608 and 610 are shown. The conductive layers 608 and 610 can have different sheet resistances (sheet resistance is resistance per unit). For example, the conductive layer 608 may have a higher sheet resistance than the conductive layer 610 such that, where the conductive layer 610 is present, the majority of the current goes through the conductive layer 610. Thus, the conductive layer 610 acts as a conducting line and may be used to route signals, and the conductive layer 608 acts as a resistive line, and may be used as a resistor. The metal layer 606 may be formed by first depositing the conductive layer 608, depositing the conductive layer 610, and then etching the conductive layer 610 to expose portions of the conductive layer 608. In particular, a portion 134 of the conductive layer 608 under the chamber 152 is exposed. The exposed portion 134 provides a surface of a resistor under the chamber 152 thermally coupled to the chamber 152. Similar to the device 100, the polysilicon structure 116 causes an un-even surface of the resistor (e.g., uneven surface of the metal layer 608 in the exposed portion 134). Such an uneven surface of the resistor improves the thermal efficiency. In addition, the topology variation in the resistor surface can achieve lower STOE for the resistor.

Figure 7:
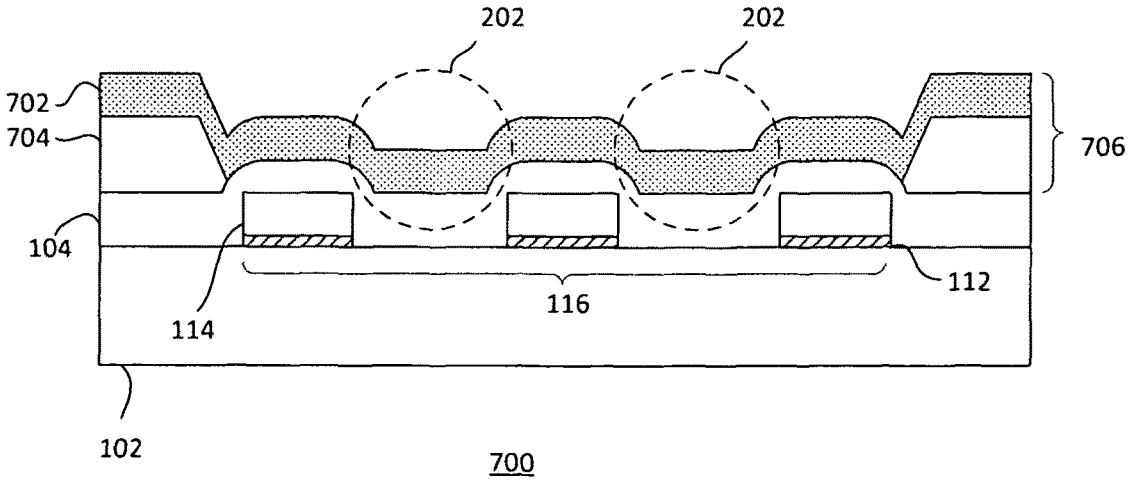
FIG. 7 is a cross-section diagram of a resistor portion of a fluid ejection device according to another example implementation.

FIG. 7 is a cross-section diagram of a resistor portion 700 of a fluid ejection device according to an example implementation. Elements of FIG. 7 that are the same or similar to FIG. 2 are designated with identical reference numerals and are described in detail above. The device 700 is similar to the device 200, with the exception that the resistor is formed having two conductive layers for the extent of the resistor without an exposed portion having only a single conductive layer. The device 700 is another example of using a polysilicon structure under a TIJ resistor to alter the topography of the resistor surface to improve thermal efficiency and STOE. It is to be understood that use of a polysilicon structure under a TIJ resistor can be employed in still further variations/configurations of resistor designs, of which devices 200 and 700 are examples. Further, the resistor portion 700 can be used in place of the resistor portion 200 in devices 100 and 600.

The resistor portion 700 includes a metal layer 706 deposited on the dielectric 104. The metal layer 706 includes a metal layer 702 deposited on a metal layer 704. Similar to the device 200, the polysilicon structure 116 causes an un-even surface of the resistor (e.g., uneven surface of the metal layer 702 such that valleys 202 are formed). Such an uneven surface of the resistor improves the thermal efficiency. In addition, the topology variation in the resistor surface can achieve lower STOE for the resistor.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A thermal fluid ejection device, comprising:
- a substrate having a chamber formed thereon to contain a fluid;
- a metal layer comprising a resistor under the chamber having a surface thermally coupled to the chamber:
- at least one layer deposited on the metal layer:
- a polysilicon layer under the metal layer comprising a polysilicon structure under the resistor to change topography of the resistor such that the surface is uneven, the polysilicon structure including a plurality of segments.

2. The thermal fluid ejection device of claim 1, wherein the resistor comprises a first conductive layer and a second conductive layer, the first conductive layer linking two separate portions of the second conductive layer, where the surface of the resistor comprises the portion of the first conductive layer between the two separate portions of the second conductive layer.

3. The thermal fluid ejection device of claim 1, wherein the plurality of segments are formed in a grid.

4. The thermal fluid ejection device of claim 1, wherein the at least one layer includes a dielectric layer and an anti-cavitation layer.

5. The thermal fluid ejection device of claim 1, further comprising:
- a dielectric layer deposited between the polysilicon layer and the metal layer.

6. A method of manufacturing a fluid ejection device, comprising:
- forming a polysilicon layer on a substrate;
- forming a dielectric layer over the polysilicon layer;
- forming a metal layer comprising a resistor over the dielectric layer;
- forming at least one additional layer on the metal layer; and
- forming a chamber over the resistor to contain a fluid;
- wherein the resistor is formed under the chamber having a surface thermally coupled to the chamber;
- wherein the polysilicon layer includes a polysilicon structure under the resistor to change topography of the resistor such that the surface is uneven, and the polysilicon structure includes a plurality of segments.

7. The method of claim 6, wherein the resistor comprises a first conductive layer and a second conductive layer, the first conductive layer linking two separate portions of the second conductive layer, where the surface of the resistor comprises the portion of the first conductive layer between the two separate portions of the second conductive layer.

8. The thermal fluid ejection device of claim 6, wherein the plurality of segments are formed in a grid.

9. A printhead for a printer, comprising:
- at least one nozzle;
- a chamber fluidically coupled to the nozzle; and
- a thin-film stack under the chamber, including:
  - a metal layer comprising a resistor under the chamber having a surface thermally coupled to the chamber;
  - at least one layer deposited on the metal layer;
  - a polysilicon layer under the metal layer comprising a polysilicon structure under the resistor to change topography of the resistor such that the surface is uneven the polysilicon structure including a plurality of segments.

10. The printhead of claim 9, wherein the resistor comprises a first conductive layer and a second conductive layer, the first conductive layer linking two separate portions of the second conductive layer, where the surface of the resistor comprises the portion of the first conductive layer between the two separate portions of the second conductive layer.

11. The printhead of claim, 9, wherein the plurality of segments are formed in a grid.

12. The printhead of claim 9, wherein the at least one layer includes a dielectric layer and an anti-cavitation layer.

* * * * *